US009854368B2

(12) United States Patent
Andersen

(10) Patent No.: US 9,854,368 B2
(45) Date of Patent: Dec. 26, 2017

(54) METHOD OF OPERATING A HEARING AID SYSTEM AND A HEARING AID SYSTEM

(71) Applicant: Widex A/S, Lynge (DK)

(72) Inventor: Kristian Timm Andersen, Lynge (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 15/157,880

(22) Filed: May 18, 2016

(65) Prior Publication Data

US 2016/0261961 A1 Sep. 8, 2016

Related U.S. Application Data

(63) Continuation-in-part of application No. PCT/EP2013/074943, filed on Nov. 28, 2013.

(51) Int. Cl.
*H04R 25/00* (2006.01)
*G10L 21/0232* (2013.01)

(52) U.S. Cl.
CPC ..... *H04R 25/50* (2013.01); *H04R 25/505* (2013.01); *G10L 21/0232* (2013.01); *H04R 2225/43* (2013.01)

(58) Field of Classification Search
CPC ..... H04R 25/50; H04R 25/552
USPC ..... 340/4.14; 381/23.1, 92, 312, 315, 316, 381/318, 320, 321, 328, 56, 314; 600/25; 607/57
See application file for complete search history.

(56) References Cited

U.S. PATENT DOCUMENTS 5,511,128 A * 4/1996 Lindemann ..... H04R 25/552 381/356
5,651,071 A * 7/1997 Lindemann ..... H04R 25/552 381/314
6,240,192 B1 * 5/2001 Brennan ..... H04R 25/505 381/312
2002/0191799 A1 * 12/2002 Nordqvist ..... G10L 25/69 381/56
2004/0066944 A1 * 4/2004 Leenen ..... H04R 25/305 381/314
2004/0247145 A1 * 12/2004 Luo ..... H04R 25/43 381/312
2006/0178553 A1 * 8/2006 Neisz ..... H04R 25/606 600/25
2006/0200344 A1 9/2006 Kosek et al.
2006/0222192 A1 * 10/2006 Matthey ..... G10L 21/02 381/312
2007/0182579 A1 * 8/2007 Hughes, Jr. ..... G09B 21/009 340/4.14
2009/0010465 A1 * 1/2009 Boguslayskij ..... H04R 25/558 381/315

(Continued)

OTHER PUBLICATIONS

Dirk Mauler et. al., "Improved Reproduction of Stops in Noise Reduction Systems with Adaptive Windows and Nonstationarity Detection", EURASIP Journal on Advances in Signal Processing, vol. 2009, Article ID 469480, pp. 1-17.

(Continued)

*Primary Examiner* — Gerald Gauthier
(74) *Attorney, Agent, or Firm* — Sughrue Mion, PLLC

(57) ABSTRACT

A method of operating a hearing aid system using adaptive time-frequency analysis in order to provide improved noise reduction and enhanced speech intelligibility, and a hearing aid system (100, 200) comprising an adaptive filter bank.

18 Claims, 3 Drawing Sheets

(56) References Cited

U.S. PATENT DOCUMENTS

2010/0020995 A1* 1/2010 Elmedyb ..... H04R 25/552 381/318
2010/0027820 A1* 2/2010 Kates ..... G10L 25/00 381/312
2010/0042183 A1* 2/2010 Beck ..... H04R 25/606 607/57
2011/0007918 A1* 1/2011 Bauml ..... H03H 17/0266 381/320
2012/0134522 A1* 5/2012 Jenison ..... H04R 25/505 381/320
2013/0190552 A1* 7/2013 Leblans ..... H04R 25/00 600/25
2014/0056453 A1* 2/2014 Olsen ..... H04R 25/02 381/328
2014/0072156 A1* 3/2014 Kwon ..... H04R 25/453 381/318
2014/0247956 A1* 9/2014 Andersen ..... H04R 25/70 381/316
2014/0270294 A1* 9/2014 Andersen ..... G10L 21/02 381/321
2015/0003652 A1* 1/2015 Bisgaard ..... H04R 25/50 381/314
2015/0172831 A1* 6/2015 Dittberner ..... H04R 25/70 381/314
2016/0088407 A1* 3/2016 Elmedyb ..... H04R 25/405 381/23.1
2016/0261961 A1* 9/2016 Andersen ..... H04R 25/505

OTHER PUBLICATIONS

Daniel Rudoy et. al., "Superposition Frames for Adaptive Time-Frequency Analysis and Fast Reconstruction", IEEE Transactions on Signal Processing, May 1, 2010, vol. 58, No. 5.
International Search Report of PCT/EP2013/074943 dated Aug. 5, 2014 [PCT/ISA/210].
Written Opinion of PCT/EP2013/074943 dated Aug. 5, 2014 [PCT/ISA/237].

* cited by examiner

METHOD OF OPERATING A HEARING AID SYSTEM AND A HEARING AID SYSTEM

RELATED APPLICATIONS

The present application is a continuation-in-part of application PCT/EP 2013074943, filed on 28 Nov. 2013, in Europe, and published as WO 2015078501 A1.

BACKGROUND OF THE INVENTION

1. Field of the Invention

The present invention relates to a method of operating a hearing aid system. The present invention also relates to a hearing aid system adapted to carry out said method.

Within the context of the present disclosure a hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor adapted to provide amplification in those parts of the audible frequency range where the user suffers a hearing deficit, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, such as a smart phone having software applications adapted to interact with other devices of the hearing aid system. Thus within the present context the term "hearing aid system device" may denote a hearing aid or an external device.

Generally a hearing aid system according to the invention is understood as meaning any system which provides an output signal that can be perceived as an acoustic signal by a user or contributes to providing such an output signal and which has means which are used to compensate for an individual hearing loss of the user or contribute to compensating for the hearing loss of the user. These systems may comprise hearing aids which can be worn on the body or on the head, in particular on or in the ear, and hearing aids that can be fully or partially implanted. However, some devices whose main aim is not to compensate for a hearing loss may nevertheless be considered a hearing aid system, for example consumer electronic devices (televisions, hi-fi systems, mobile phones, MP3 players etc.) provided they have measures for compensating for an individual hearing loss.

Speech enhancement is a fundamental challenge in real-time sound devices such as hearings aids. It is a key reason for hearing impaired people for getting a hearing aid. Traditional speech enhancement or noise suppression techniques consist of splitting the input signals into a number of frequency bands, processing each band according to a selected strategy generally designed to enhance bands carrying speech and to suppress bands carrying noise, and finally combining the bands into a broadband output signal. The width and sharpness of the filters will effectively determine the resolution in time and frequency. Some signal segments consist of narrow frequency components stationary over long periods (e.g., vowels) while other signal segments have a very short duration but span a wide frequency range (e.g., many consonants). If signal components of different types are not processed differently, it is hard to find an appropriate trade-off between resolution in time and resolution in frequency.

In the following, a set-up where noisy speech is processed through a number of fixed filter banks is considered and the inherent limitations of this approach are illustrated. To keep focus on the time- and frequency-resolution of the filter bank, delay constraints are ignored and an ideal Wiener filter is used to process the signal where the noise and speech estimates are obtained from the clean noise and clean speech signals respectively. The analysis window is a Hann window with 50% overlap, and the signal is synthesized using overlap-add. The input signal is speech mixed with speech-shaped noise at different signal-to-noise ratios, and the SNR gain is measured as a function of the length of the analysis window. The results can be seen in FIG. 1. The SNR gain increases as a function of the window length until about 65 miliseconds (ms). For short windows (<10 ms), the sound is heavily affected by musical noise. This is due to statistical variations in the signal estimates, even when the true signals are used. For long windows (>60 ms) the sound has an 'echo' effect due to the temporal smearing of the gain envelope. From an energy point of view, a window around 65 ms is optimal since this window length gives a better frequency resolution while not being longer than the long voiced sounds in speech that contain most of the energy in speech. Even though this window length is optimal from an energy point of view, it is usually not a good choice in practice, since it smears transient events like plosives in speech or transition periods.

Therefore a short window is preferred for processing e.g. a 't'. The reason why this is not reflected in FIG. 1 is that transients have very little energy compared to the longer voiced sounds even though they are important for speech intelligibility.

Considering the plosive 'p' in the beginning of the word 'puzzle' a long window will smoothe out the plosive and make the word sound like 'huzzle' instead of "puzzle". This illustrates how long windows can have disastrous results on speech intelligibility because they smear the transients. In practice, a window around 20-30 ms is often chosen as a trade-off between good time resolution and efficient noise suppression arising from a long time window.

Additionally, it is instrumental for the real-time processing carried out in a hearing aid system that the group delay is kept very low to ensure that other people's speech is still perceived as being synchronized with their lip movement and that a user's own speech and sound from the external environment propagating into the ear canal, e.g. through a hearing aid vent, does not get too much out of sync with the sound coming from a hearing aid loudspeaker, whereby a comb-filter effect might result. The choice of filter bank is consequently a fundamental decision for real-time speech enhancement in a hearing aid system as the design is bound to limit some aspects of the performance.

2. The Prior Art

In the paper "Superposition Frames for Adaptive Time-Frequency Analysis and Fast Reconstruction", by D. Rudoy et. al. in IEEE Transactions on Signal Processing, Vol. 58, 5, May 2010, the tradeoff between time and frequency resolution is addressed by growing a time window by merging the shortest desired windows based on an evaluation of local spectral kurtosis.

In the paper "Improved Reproduction of Stops in Noise Reduction Systems with Adaptive Windows and Nonstationarity Detection" by D. Mauler, R. Martin, in EURASIP Journal on Advances in Signal Processing Volume 2009, Article ID 469480, a real time analysis-synthesis filter bank is developed with a constraint of 10 ms time delay, where a short and a long analysis window is switched depending on the stationarity of the signal.

It is therefore a feature of the present invention to provide a method of operating a hearing system with improved noise suppression.

It is another feature of the present invention to provide a method of adaptive time-frequency analysis using an algorithm having processing power requirements suitable for implementation in a hearing aid system.

It is still another feature of the present invention to provide a method of adaptive time-frequency analysis in a hearing aid system that can be carried out independently for a number of frequency ranges.

It is yet another feature of the present invention to provide a hearing aid system that is adapted to carry out said above mentioned methods.

SUMMARY OF THE INVENTION

The invention, in a first aspect, provides a method of operating a hearing aid system comprising the steps of providing a digital input signal, representing the output from an input transducer of the hearing aid system, selecting a first window function, selecting a first length of the first window function, providing a second window function by zero padding the first window function such that the second window function a second length, wherein the second length is larger than the first length, applying the second window function to the digital input signal and using a discrete Fourier transform to calculate a first time-frequency-distribution at a first point in time for the digital input signal, determining a first value of a measure of the energy in the digital input signal at a subsequent second point in time, applying the second window function to the digital input signal and using a discrete Fourier transform to calculate a second time-frequency-distribution at said second point in time, evaluating the first value of the measure of the energy in the digital input signal in order to select how to determine an adaptive time-frequency bin, having a specific frequency index, at said second point in time, using, in response to a first result of said evaluation, the second time-frequency distribution to determine the adaptive time-frequency bin, applying, in response to a second result of said evaluation, a phase shift, corresponding to the time shift between the first and the second point in time, to a frequency bin of the first time-frequency-distribution hereby providing a phase shifted time-frequency bin and adding the phase shifted time-frequency bin to the corresponding frequency bin of the second time-frequency-distribution, hereby providing the adaptive frequency bin, deriving a gain value for the hearing aid system based on the adaptive time-frequency bin in order to suppress noise, applying said gain value to a signal in a primary signal path of the hearing aid system, said primary signal path including at least the hearing aid system input transducer, and the hearing aid system output transducer.

This provides a method that improves noise suppression and speech enhancement in a hearing aid system.

The invention, in a second aspect, provides a hearing aid system comprising an adaptive filter bank configured to provide an adaptive time-frequency distribution of a digital input signal representing the output from an input transducer of the hearing aid system, wherein said adaptive filter bank is configured such that a time-frequency bin X(k,i) of said time-frequency distribution is determined as either:

$$X(k, i) = X_1(k, i) + X(k, i-1)e^{\frac{2\pi jRk}{L}}$$

or as $$X(k,i)=X_1(k,i)$$

wherein $X_1$ (k,i) is a time-frequency bin resulting from a discrete Fourier transform of a digital input signal based on a zero-padded second window comprising a single first window, and wherein k and i represent the frequency and time indices respectively, wherein X(k,i−1) represents a time-frequency bin based on the zero-padded second window comprising one or more of said first windows calculated at a previous time sample i−1 relative to the current time sample i, wherein L represents the length of the second window and R represents the hop-size of the first windows when summing these in the time domain, wherein X(k,i) is calculated as $$X_1(k, i) = X(k, i-1)e^{\frac{2\pi jRk}{L}}$$

in response to a determination of the digital input signal being stationary, and wherein X(k,i) is calculated as $X_1$(k,i) in response to a determination of the digital input signal not being stationary.

This provides a hearing aid system adapted for improved noise suppression.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings:

FIG. 2 illustrates highly schematically a hearing aid system according to an embodiment of the invention; and.

DETAILED DESCRIPTION

Figure 1:
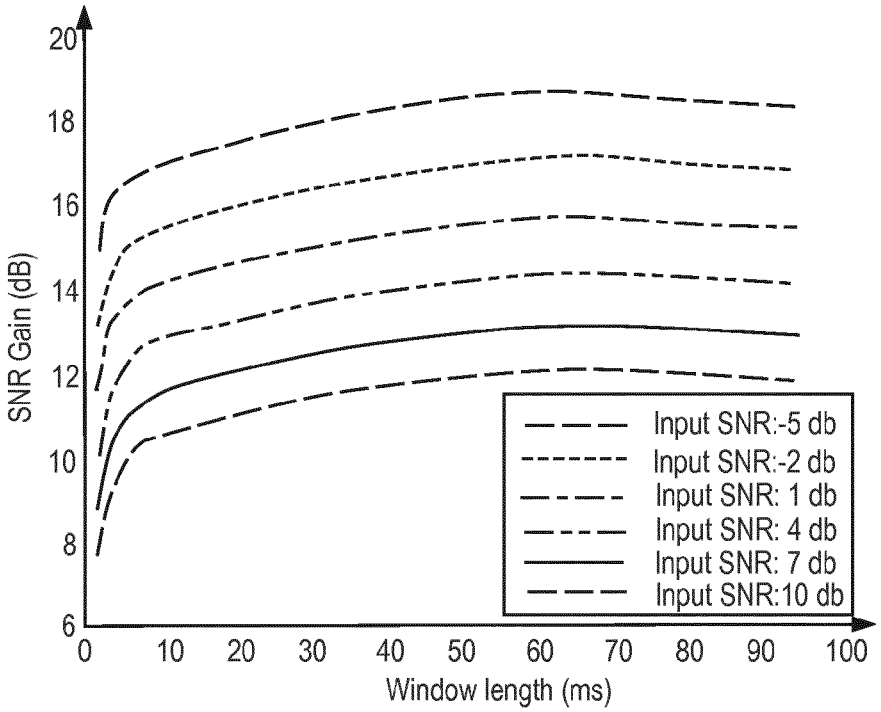
FIG. 1 is a graph illustrating the Signal-to-Noise-Ratio (SNR) gain of speech in noise signals as a function of the window length for a number of fixed filter banks according to the prior art.

Reference is first made to a method of operating a hearing aid system according to a first embodiment of the invention.

The method according to the first embodiment comprises the steps of: providing a digital input signal, in the time domain, representing the output from a hearing aid system input transducer, using an adaptive filter bank to transform the digital input signal into the time-frequency domain, and deriving a frequency dependent noise suppression gain based on analysis of the transformed digital input signal.

Consider initially a Hann window h(n) of length N given by:

$$h(n) = \frac{1}{2}\left(1 - \cos\left(\frac{2\pi n}{N}\right)\right), 0 \le n < N \tag{1}$$

wherein n represents the sample of the digital input signal.

An aggregate window is obtained by summing a first Hann window with a second succeeding (in time) Hann window with a hop-size, i.e. number of samples the window is advanced for each frame of, R=N/2.

The aggregate window may be further grown by summing more windows. The aggregate window is zero-padded in front of at least one Hann window such that the frame that is to be used to transform the digital input signal into the time-frequency domain has a constant length L whereby the number of bins in the time-frequency domain is preserved independent of the number of summed Hann windows used to form the aggregate window.

According to the present embodiment the length N is 4 miliseconds and the length L is 32 miliseconds. However, according to variations the length N of the first window may be in the range between 2 miliseconds and 16 miliseconds, and the length L may be in the range between 10 miliseconds and 96 miliseconds.

According to the present embodiment the number of bins in the time-frequency domain is 128, in variations the number of bins may be in range between 32 and 1024, depending on both the length L and the sample rate of the hearing aid system.

According to variations of the first embodiment, other windows, e.g. the Bartlett, Hamming and Blackmann-Harris window, and other hop-sizes, such as e.g. N/4, may be used.

According to a specific variation a weighting is applied to the short windows as part of the summing process in order to make the aggregate window asymmetric.

According to the first embodiment of the method of the invention the criterion used to determine whether the aggregate window should continue to grow is the Likelihood Ratio Test. Assuming that the discrete digital input signal x(n) is a realization of a zero mean Gaussian independent and identically distributed random variable with variance $\sigma_x^2$, then the variance $\sigma_x^2$ can be estimated from it's maximum likelihood estimate:

$$\sigma_x^2 = \frac{1}{T}\sum_n x(n)^2 \tag{2}$$

where T is the length of the signal frame from which the variance is estimated, and x(n) represents the digitized output from a hearing aid input transducer.

To test whether a subsequent frame of the digital input signal x(n) with variance $\sigma_y^2$ belongs to the same statistical process, a test statistic, the Likelihood Ratio Test (LRT) can be defined as:

$$LRT = \frac{\sigma_y}{\sigma_x} e^{-\frac{1}{2}\left(\frac{\sigma_y^2}{\sigma_x^2} - 1\right)} \tag{3}$$

Subsequently the value of the Likelihood Ratio Test can be compared with a predetermined threshold value λ and in case the Likelihood Ratio Test is above said predetermined threshold value λ, then the size of the aggregate window is grown. In the present embodiment the threshold value λ is set to 0.6.

The Likelihood Ratio Test hereby provides a method of evaluating the stationarity of the digital input signal. In the present context stationarity may be understood as a measure of how much the statistical parameters, e.g. the mean and the standard deviation of the digital input signal, change with time.

The equations for determining the time-frequency bins as a function of the effective length of the aggregate window (as determined primarily by the number M of summed Hann windows) are given below.

The equations are advantageous over the prior art in that they are computationally inexpensive to implement and especially in that they allow the effective length of the aggregate window to be varied independently for each frequency bin in the time-frequency domain. In the following frequency bin and time-frequency bin may be used interchangeably.

Thus the effective length of the aggregate window is defined primarily by the number M of summed Hann windows in the aggregate window used to transform the digital input signal into the time-frequency domain. However, the effective time and frequency resolution also depends on other characteristics of the aggregate window such as the type of window function used to form the aggregate window, possible individual weighting of the windows used to form the aggregate window as well as the hop size applied when summing the windows used to form the aggregate window.

Given a sum $g_M(n)$ of M Hann windows:

$$g_M(n) = \sum_{m=0}^{M-1} h(L - N - mR + n) \tag{4}$$

Since the sum of windows (the aggregate window), along with zero-padding, is assumed to have length L, the resulting time-frequency distribution may be calculated using a Discrete Fourier Transform (DFT), whereby the resulting time-frequency bins $X_M(k,i)$ may be found as:

$$X_M(k, i) = \sum_{n=0}^{L-1} g_M(n) \times (n + iR) e^{-\frac{2\pi jnk}{L}} \tag{5}$$

where k is the frequency index and i is the time index. For each new time index i, the aggregate window is either reset to comprise only a single short Hann window or grown by one short Hann window. If the aggregate window is reset and the resulting time-frequency bins may be denoted $X_1(k, i)$ and is determined by inserting M=1 in equation (4) and (5) hereby providing:

$$X_1(k, i) = \sum_{n=0}^{L-1} g_1(n) \times (n + iR) e^{-\frac{2\pi jnk}{L}} \tag{6}$$

It is noted that a single DFT of the digital input signal based on the window $g_1(n)$ is sufficient to provide $X_1(k,i)$ for all the relevant frequency indices k.

It is also noted that the Discrete Fourier Transform (DFT) is carried out using a Fast Fourier Transform (FFT), which is a highly effective algorithm that is very well suited for implementation in a hearing aid system.

Consider now the case where a time-frequency bin $X_M(k, i)$ that has been calculated using an aggregate window comprising M short Hann windows needs to be updated with one additional short Hann window added to the aggregate window such that the aggregate window comprises M+1 short Hann windows. The inventor has found that the resulting time-frequency bin $X_{M+1}(k,i)$ may be derived as:

$$\begin{aligned} X_{M+1}(k, i) &= \sum_{n=0}^{L-1} g_{M+1}(n) \times (n + iR) e^{-\frac{2\pi jnk}{L}} = \\ &\sum_{n=0}^{L-1} (g_1(n) + g_M(n + R)) \times (n + iR) e^{-\frac{2\pi jnk}{L}} = \\ &\sum_{n=0}^{L-1} g_1(n) \times (n + iR) e^{-\frac{2\pi jnk}{L}} + \\ &\sum_{n=0}^{L-1} g_M(n) \times (n + (i-1)R) e^{-\frac{2\pi j(n-R)k}{L}} = \\ &X_1(k, i) + X_M(k, i-1) e^{\frac{2\pi jRk}{L}} \end{aligned} \tag{7}$$

It follows directly from the update equation that the updated time-frequency bin $X_{M+1}(k,i)$ can be calculated adaptively in the time-frequency domain by adding the previous time-frequency bin $X_M(k,i-1)$, calculated at a first point in time, to the time-frequency bin based on an aggregate window having only a single short Hann window and calculated at a subsequent second point in time $X_1(k,i)$ and by applying a phase shift $$e^{\frac{2\pi jRk}{L}}$$

to the previous time-frequency bin $X_M(k,i-1)$, calculated at said first point in time, wherein the applied phase shift in the time-frequency domain is equivalent to a time-shift of R in the time domain. It is noted that the time-shift of R corresponds to the time interval between two updates of the time-frequency bins, i.e. the time between said first and second points in time.

It is a specific advantage of the present invention that each frequency bin can be updated independently. Consequently, one frequency bin, having a frequency index $k_1$, may be updated simply by setting the updated time-frequency bin equal to the most recent time-frequency bin calculated based on an aggregate window having only a single short Hann window, which is denoted $X_1(k_1,i)$, while another frequency bin, having a frequency index $k_2$, may be updated by adding the most recent time-frequency bin calculated based on an aggregate window having only a single short Hann window $X_1(k_2,i)$ to the phase shifted previous time-frequency bin $$X_M(k_2, i-1) e^{\frac{2\pi jRk}{L}}$$

as described in the previous section.

It is a further advantage of the present invention that each frequency bin may be calculated based on an aggregate window having a number M of short windows, wherein said number M may differ for the individual frequency bins. However, the update equation uses the same input namely $X_1(k_1,i)$ and the phase shifted version of a previous time frequency bin $$X_M(k_2, i-1) e^{\frac{2\pi jRk}{L}}$$

and is of the same form for all the frequency bins. This provides a method of time-frequency analysis that is very processing efficient.

It is noted that the update equation (7) of the present embodiment represents a specific variation of the more general expression given below in equation (8):

$$X(k, i) = \sum_{p=0}^{P-1} a_p X_1(k, i-p) e^{\frac{2\pi jRkp}{L}} + \sum_{p=1}^{P-1} b_p X(k, i-p) e^{\frac{2\pi jRkp}{L}} \tag{8}$$

Wherein X(k,i) is the resulting time-frequency bin for frequency index k at time index i. It follows directly that equation (7) can be obtained from equation (8) by setting $a_0=1$, $b_1=1$ and all other coefficients to zero and by noting that the expressions $X_{M+1}$ and $X_M$ have been replaced by the more general expression X in order to emphasize that all expressions simply represent the value of a time-frequency bin at a given point in time. Hereby the general expression takes into account the situation, where e.g. the number of summed short windows in the aggregate window is not grown but instead simply is maintained.

However, in variations of the present embodiment other coefficients may be selected such as e.g. $a_0=1$ and $b_1=0.9$, whereby the update equation provides an auto-regressive filtering of the digital input signal that weights the current sample highest. Basically the auto-regressive filtering provides an aggregate window that is asymmetric.

In a further variation the weighting constants may be variable as a function of time, whereby a time-varying adaptive filtering can be achieved.

In the preceding derivation, it has been assumed that the sum of short windows (the aggregate window), along with zero-padding, has length L. If the signal in a frequency bin is stationary for a longer duration than L, then the length of the aggregate window will eventually grow beyond the allocated time frame of length L.

In order to cope with such a case, consider now a case where it is assumed that the sum of short windows, along with zero-padding, has length SL, where S is a positive integer. In this case the frequency analysis becomes:

$$X_M(k, i) = \sum_{n=-(S-1)L}^{L-1} g_M(n) \times (n + iR) e^{-\frac{2\pi jnk}{L}} = \tag{9}$$

-continued $$\sum_{s=0}^{S-1}\sum_{n=0}^{L-1} g_M(n-sL)\times(n+iR-sL)e^{-\frac{2\pi j(n-sL)k}{L}} = \sum_{n=0}^{L-1}\left[\sum_{s=0}^{S-1} g_M(n-sL)\times(n+iR-sL)\right]e^{-\frac{2\pi jnk}{L}}$$

and the update equation for the resulting time-frequency bin $X_{M+1}(k,i)$ may be derived as:

$$X_{M+1}(k,i) = \sum_{n=-SL}^{L-1} g_{M+1}(n)\times(n+iR)e^{-\frac{2\pi jnk}{L}} = \sum_{n=-SL}^{L-1}(g_1(n)+g_M(n+R))\times(n+iR)e^{-\frac{2\pi jnk}{L}} = \sum_{n=0}^{L-1} g_1(n)\times(n+iR)e^{-\frac{2\pi jnk}{L}} + \sum_{n=-(S-1)L}^{L-1} g_M(n)\times(n+(i-1)R)e^{-\frac{2\pi j(n-R)k}{L}} = X_1(k,i)+X_M(k,i-1)e^{-\frac{2\pi jRk}{L}} \quad (10)$$

This is the same result as in the case where the length of the aggregate window was set to L. It therefore follows that it is a further specific advantage of the present invention that the update equations need not keep track of how many short windows that have been summed. Hereby the processing efficiency of the time-frequency analysis may be further improved.

According to a variation of the first method embodiment, the aggregate window may be updated such that, in addition to be either reset or grown by one short window, the length of the aggregate window is maintained. The equation for maintaining the aggregate window has been found to be:

$$X(k,i) = X_1(k,i) + X(k,i-1)e^{\frac{2\pi jRk}{L}} - X_1(k,i-M)e^{\frac{2\pi jMRk}{L}} \quad (11)$$

wherein the expression $X_1(k,i-M)$ represents a time-frequency bin based on an aggregate window having only a single short Hann window and calculated at the point in time "i−M" where M is the number of summed short Hann windows in the current aggregate window.

According to yet another variation the calculated time-frequency distributions are to be used for noise suppression in the hearing aid system. In this case the calculated time-frequency distributions are normalized for each frequency bin with a predetermined value that depends on the length of the aggregate window. In this way the energy in each frequency bin remains approximately constant independent on the number M of summed windows in the aggregate window.

According to further variations the criterion used to determine whether the length of the aggregate window is grown, reset or maintained is based on a more direct evaluation of the energy content in the digital input signal.

According to one specific variation the energy measure $R_1$ is defined as the ratio between the energy in the current time-frequency bin, based on an aggregate window having only one short window, and the previous time-frequency bin based on the resulting time-frequency distribution at that previous point in time:

$$R_1(k,i) = \frac{|X_1(k,i)|^2}{|X_M(k,i-1)|^2/M} \quad (12)$$

According to a further variation the energy measure $R_{1b}$ may be modified by summing the energy in a number K of adjacent current time-frequency bins based on an aggregate window having only one short window, in order to provide the numerator, and, in order to provide the denominator, by summing the energy of the same number K of adjacent previous time-frequency bins based on the resulting time-frequency distribution at that previous point in time:

$$R_{1b}(k,i) = \frac{\Sigma_K|X_1(k,i)|^2}{\Sigma_K|X_M(k,i-1)|^2/M} \quad (13)$$

It is a specific advantage of the energy measures $R_1$ and $R_{1b}$ that they are well suited to determine criteria for whether to grow, reset or maintain the number M of summed short windows comprised in the aggregate window.

According to a specific embodiment a first upper threshold value of 1.4 and a first lower threshold of 0.7 are defined and in case the value of the energy measure is above the first upper threshold or below the first lower threshold then the number M of summed windows is either maintained if the energy measure is relatively close to either of the first thresholds or reset if the energy measure is relatively far from either of the first thresholds, i.e. above a second upper threshold value of 2.0 or below a second lower threshold value of 0.5. If, on the other hand, the value of the energy measure is between the first upper and first lower threshold, then the number M of summed windows in the aggregate window is increased by one.

However, according to a simplified variation, the option of maintaining the number M of summed windows is not included and instead the number M of summed windows is simply reset if the energy measure is above the first upper threshold or below the first lower threshold. According to yet other variations the energy measure may be reset if the energy measure is above an upper threshold being in the range of said first and second upper thresholds or below a lower threshold being in the range of said first and second lower thresholds.

The criteria based on the energy measures $R_1$ and $R_{1b}$ are similar to the criterion of the first method embodiment insofar that an energy measure with a value close to one reflects that the input digital signal is stationary.

According to the present embodiment the aggregate window that is used for the discrete Fourier transformation, has a length L of 32 miliseconds, which provides a frequency resolution (frequency distance between the time-frequency bins) of 31.25 Hz.

The inventor has found that the value of K (i.e. the number of adjacent frequency bins to be summed in equation (13)) preferably should be selected such that the summed time-frequency bins cover a frequency range of at least 400 Hz. Consequently K is in the present embodiment set to 14. However, in variations K can be set to basically any value between say 3 and 248 depending on the length of the aggregate window and depending on the desired frequency range of the summed time-frequency bins.

According to a variation K can be made dependent on the considered time-frequency bin such that K increases with the absolute value of the frequency of the time-frequency bins whereby the frequency resolution provided by the adaptive filter based on the energy measure $R_{1b}$ will be similar to the typical frequency resolution of a human ear.

According to yet another variation the criterion for determining whether to grow, maintain or reset the number M of short windows in the aggregate window, for a specific time-frequency bin, is simply to select the time-frequency bin, among the possible updated time-frequency bins $X_1(k,i)$, $X_M(k,i)$ or $X_{m+1}(k,i)$, that has the lowest energy. The lowest possible energy $R_2(k,i)$ for a specific time-frequency bin can be found as:

$$R_2(k,i)=\mathrm{MIN}(|X_1(k,i)|^2, |X_M(k,i)|^2, |X_{M+1}(k,i)|^2 \quad (14)$$

This criterion is advantageous in that it adapts toward the most optimum aggregate window and thus time and frequency resolution of the digital input signal without having to rely on assumptions of the digital input signal or predetermined constants. This criterion is especially advantageous in that it optimizes the calculated time-frequency bins such that they comprise as little as possible excess energy leaked in from neighboring frequency bins.

However the criterion is disadvantageous in that it requires more processing power since all three possible time-frequency bins need to be determined.

According to a further variation, the selection of the time-frequency bin $X_1(k,i)$, $X_M(k,i)$ or $X_{m+1}(k,i)$ having the lowest energy $R_2(k,i)$ is only carried out after one of the energy measures $R_1(k,i)$ or $R_{1b}(k,i)$ has been used to determine that the signal in a given frequency bin is stationary. Hereby the aggregate window can be reset, i.e. the time-frequency bin $X_1(k,i)$ is selected, when a non-stationarity is detected. Generally it is not possible to detect a non-stationarity based purely on selecting the time-frequency bin having the lowest energy.

Thus within the present context the term "a measure of the energy in the digital input signal" covers both the criterion based on direct energy measures, such as $R_1$, $R_{1b}$ and $R_2$ above, as well as the more indirect energy measures used in the Likelihood Ratio Test. Furthermore it is noted that the energy in the digital input signal can be considered in both the time domain and in the time-frequency domain.

Figure 2:
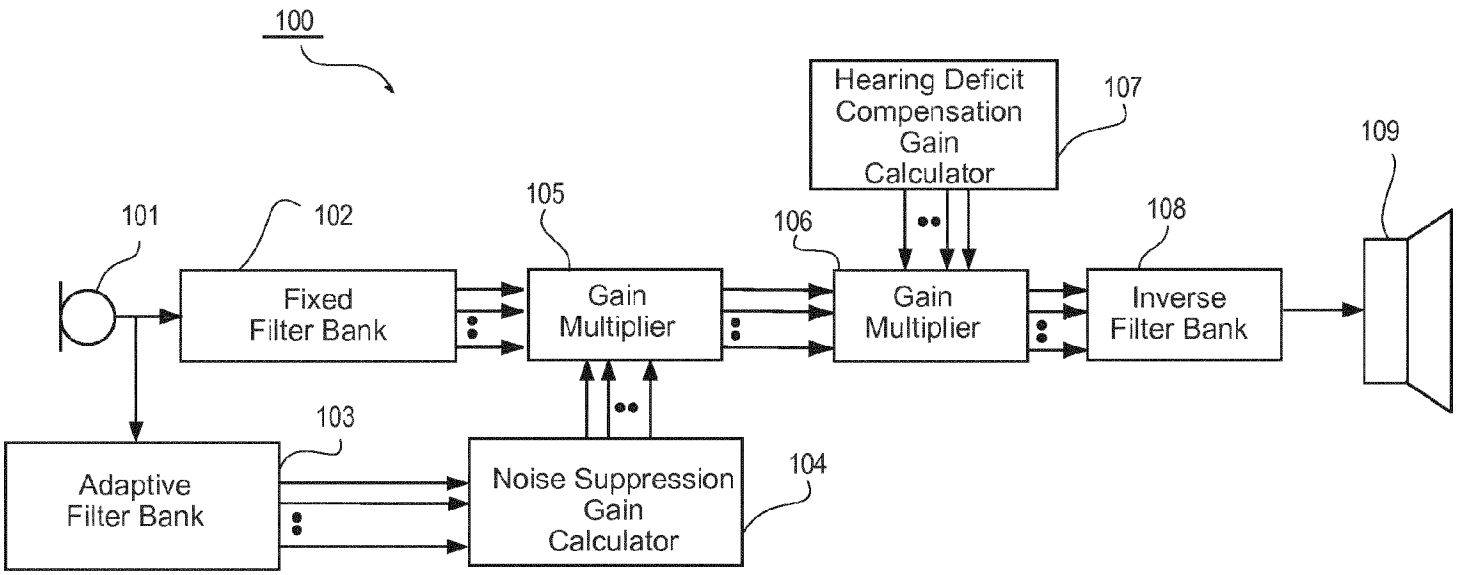

Reference is now made to FIG. 2, which illustrates highly schematically a hearing aid system 100 according to an embodiment of the invention.

The hearing aid system 100 comprises an acoustical-electrical input transducer 101, a fixed filter bank 102, an adaptive filter bank 103, a noise suppression gain calculator 104, a first gain multiplier 105, a second gain multiplier 106, a hearing deficit compensation gain calculator 107, an inverse filter bank 108 and an electrical-acoustical output transducer 109.

The acoustical-electrical input transducer 101 provides an analog electrical signal that is input to an analog-to-digital converter (not shown) that provides a digital input signal. The digital input signal is provided to the fixed filter bank 102 and to the adaptive filter bank 103.

The fixed filter bank 102 is adapted to split the digital input signal into a number a frequency bands suitable for allowing a frequency dependent hearing deficit to be compensated. Such a filter bank is well known within the art of hearing aids.

The adaptive filter bank 103 is adapted to operate in accordance with the method according to the first embodiment of the invention and as such provides to the noise suppression gain calculator 104 the digital input signal after it has been transformed into the time-frequency domain with a number of frequency bins that correspond to the number of frequency bands provided by the filter bank 102 and wherein the time and frequency resolution of each frequency bin has been individually adapted independent on the other frequency bins.

The noise suppression gain calculator 104 according to the present embodiment estimates the noise in each individual frequency bin as the 10% percentile and the signal-plus-noise estimate in each individual frequency bin as the 90% percentile, but in variations basically any of the many and well known methods, within the art of hearing aids, for noise estimation and signal-plus-noise estimation, may be applied. These methods include e.g. methods based on minimum statistics.

The noise suppression gain calculator 104 further derives a frequency dependent noise suppression gain using spectral subtraction based on the noise estimate and the signal-plus noise estimate. Values of noise suppression gains are applied to suppress gain within frequency bands dominated by noise so as to let remaining frequency bands stand out more clearly for the benefit of speech intelligibility. However, in variations any of the many and well known methods, within the art of hearing aids, for deriving a frequency dependent noise suppression gain may be applied. These methods include e.g. methods based on Wiener filtering.

The hearing deficit compensation gain calculator 107 provides a frequency dependent gain adapted to compensate the hearing deficit of an individual hearing aid user. Within the art of hearing aids the hearing deficit compensation gain calculator 107 is often denoted a compressor. Methods for compensating the hearing deficit of an individual hearing aid user are also well known within the art.

The first gain multiplier 105 applies the frequency dependent gains provided by the noise suppression gain calculator 104 and the second gain multiplier 106 applies the frequency dependent gains provided by the hearing deficit compensation gain calculator 107 to the digital signals of the frequency bands provided by the fixed filter bank 102. Hereby a multitude of processed frequency band digital signals are provided by the second gain multiplier 106.

The inverse filter bank 108 combines the processed frequency band digital signals and provides the combined digital signal to a digital-analog converter (not shown) and further on to an electrical-acoustical output transducer 109.

Figure 3:
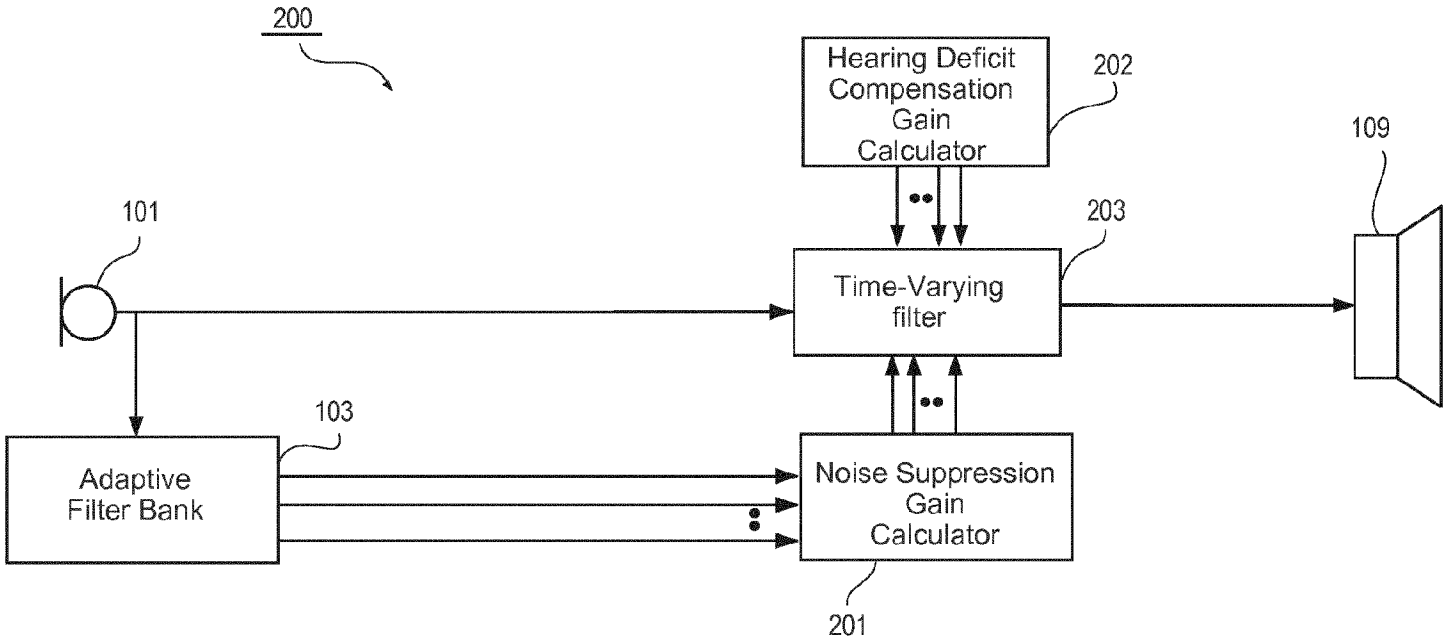
FIG. 3 illustrates highly schematically a hearing aid system according to an embodiment of the invention.

Reference is now made to FIG. 3, which illustrates highly schematically a hearing aid system 200 according to another embodiment of the invention.

The hearing aid system 200 comprises an acoustical-electrical input transducer 101, an adaptive filter bank 103, a noise suppression gain calculator 201, a hearing deficit compensation gain calculator 202, a time-varying filter 203 and an electrical-acoustical output transducer 109.

The acoustical-electrical input transducer 101 provides an analog electrical signal that is input to an analog-to-digital converter (not shown) that provides a digital input signal. The digital input signal is provided to the time-varying adaptive filter 203 and to the adaptive filter bank 103.

The time-varying filter 203 is fed with a single broadband input and has a single broadband output. The time-varying filter 203 presents an alternative to the solution given in the FIG. 2 embodiment wherein the fixed filter bank 102 is omitted whereby the group delay of the hearing aid system can be minimized.

Such time-varying filters are well known within the art of hearing aids, see e.g. chapter 8, especially page 244-255 of the book "Digital hearing aids" by James M. Kates, ISBN 978-1-59756-317-8.

The adaptive filter bank 103, the noise suppression gain calculator 201 and the hearing deficit compensation gain calculator 202 are adapted to operate in a manner similar to what has already been described for the embodiment of FIG. 2, except in that the two gain calculators are adapted to control the frequency dependent gain that the time-varying filter 203 provides.

The time-varying filter 203 provides as output a processed broad band signal that is provided to a digital-analog converter (not shown) and further on to the electrical-acoustical output transducer 109.

In further variations the adaptive filter bank may be used in basically any configuration, if the configuration provides a frequency dependent gain to be applied in a primary signal path comprising an acoustical-electrical input transducer and an electrical-acoustical output transducer, wherein said frequency dependent gain has been derived using the output provided by the adaptive filter bank according to the invention.

Thus e.g. with respect to the FIG. 2 and FIG. 3 embodiments the application of the noise suppression gain need not be applied up-stream of the hearing deficit compensating gain, and according to a further variation the noise suppression gain is calculated based, also, on the hearing deficit of the individual hearing aid user, and therefore neither the hearing deficit compensating gain nor the noise suppression gain need to be applied separately Instead a combined gain is applied that takes both the noise suppression and the hearing deficit aspects into account.

With respect to further variations of the FIG. 3 embodiment the application of the two gains derived by the noise suppression gain calculator 201 and the hearing deficit compensation gain calculator 202 may be carried out using two time-varying filters or a single time varying filter for application of the noise suppression gain and a single fixed filter bank with a gain multiplier for application of the hearing deficit compensating gain.

Thus in the present context the digital input signal need not be output directly from the input transducer, it may have undergone processing, such as amplification in order to compensate a hearing deficit or such as combination with another digital input signal in order to provide a beam formed signal, before it is used as input to the adaptive filter bank.

Generally the variations, mentioned in connection with a specific embodiment, may, where applicable, be considered variations for the other disclosed embodiments as well.

Thus e.g. the specific choice of window characteristics such as window type and window length does not depend on a specific embodiment and neither do the different methods for evaluating whether to grow, maintain or reset the aggregate method, nor does the specific implementation of noise suppression depend on a specific embodiment.

The same is true with respect to the specific choice of the weighting constants $a_p$ and $b_p$ as used in equation (8), and with respect to whether or not to include the option of maintaining the number M of summed windows as opposed to only selecting between the options of resetting (setting M equal to one) or growing (increasing M by one) the number M of summed windows.

I claim:

1. A method of operating a hearing aid system comprising the steps of:

providing a digital input signal, representing the output from an input transducer of the hearing aid system, selecting a first window function, selecting a first length of the first window function, providing a second window function by zero padding the first window function such that the second window function has a second length, wherein the second length is larger than the first length, applying the second window function to the digital input signal and using a discrete Fourier transform to calculate a first time-frequency-distribution at a first point in time for the digital input signal, determining a first value of a measure of the energy in the digital input signal at a subsequent second point in time, applying the second window function to the digital input signal and using a discrete Fourier transform to calculate a second time-frequency-distribution at said second point in time, evaluating the first value of the measure of the energy in the digital input signal in order to select how to determine an adaptive time-frequency bin, having a specific frequency index, at said second point in time, using, in response to a first result of said evaluation, the second time-frequency distribution to determine the adaptive time-frequency bin, applying, in response to a second result of said evaluation, a phase shift, corresponding to the time shift between the first and the second point in time, to a frequency bin of the first time-frequency-distribution hereby providing a phase shifted time-frequency bin and adding the phase shifted time-frequency bin to the corresponding frequency bin of the second time-frequency-distribution, hereby providing the adaptive time-frequency bin, deriving a gain value for the hearing aid system based on the adaptive time-frequency bin in order to suppress noise, applying said gain value to a signal in a primary signal path of the hearing aid system, said primary signal path including at least the hearing aid system input transducer, and the hearing aid system output transducer.

2. The method according to claim 1, comprising the further steps of:

determining a value of the measure of the energy in the digital input signal at a subsequent third point in time, applying the second window function to the digital input signal and using a discrete Fourier transform to calculate a third time-frequency-distribution at the third point in time, evaluating the value of the measure of the energy in the digital input signal, at the third point in time, in order to select how to determine an adaptive time-frequency bin, having a specific frequency index, at the third point in time, using, in response to the result of said evaluation, either the third time-frequency distribution to determine the adaptive time-frequency bin at the third point in time, or applying a phase shift, corresponding to the time shift between the third point in time and a previous point in time, to the adaptive time-frequency bin at said previous point in time hereby providing a phase shifted time-frequency bin and adding the phase shifted time-frequency bin to the corresponding frequency bin of the third time-frequency-distribution, hereby providing the adaptive frequency bin at the third point in time, deriving a gain value using the adaptive time-frequency bin, at the third point in time, and applying said gain value to a signal in the primary signal path of the hearing aid system.

3. The method according to claim 1, wherein the step of determining the adaptive time-frequency bin comprises a further step of updating at least two time-frequency bins independently in response to an independent evaluation for each of said time-frequency bins of the measure of the energy in the digital input signal.

4. The method according to claim 1, wherein said measure of the energy in the digital input signal is determined as the energy of a time-frequency bin.

5. The method according claim 1, wherein said measure of the energy in the digital input signal is determined as the ratio between the energy of a time-frequency bin, calculated based on a second window function comprising only a single first window function, and the corresponding adaptive time-frequency bin calculated at the previous time sample.

6. The method according to claim 1, wherein said measure of the energy in the digital input signal is determined as the ratio between the sum of the energy in a multitude of neighboring time-frequency bins calculated based on a second window function comprising only a single first window function, and the sum of energy in the corresponding multitude of neighboring adaptive time-frequency bins calculated at the previous time sample.

7. The method according to any claim 1, wherein said step of evaluating the value of the measure of the energy in the digital input signal in order to select how to determine an adaptive time-frequency bin comprises the further steps of:

comparing the measure of the energy of corresponding time-frequency bins from a multitude of possible adaptive time-frequency bins, and selecting as the adaptive time-frequency bin the time-frequency bin, from said multitude of possible adaptive time-frequency bins, that has the lowest energy.

8. The method according to claim 1, wherein said step of evaluating the value of the measure of the energy in the digital input signal in order to select how to determine an adaptive time-frequency distribution comprises evaluating whether said measure is below or above a predetermined threshold value.

9. The method according claim 1, wherein the step of deriving a gain value for the hearing aid system based on the adaptive time-frequency distribution comprises the further steps of:

determining a noise estimate based on an adaptive time-frequency bin, determining a signal-plus-noise estimate based on the adaptive time-frequency bin, and using a noise suppression algorithm, selected from a group of algorithms comprising at least wiener filtering, spectral subtraction, subspace methods and statistical-model based methods to derive said gain value.

10. The method according to claim 1, wherein said step of selecting a first window function comprises selecting said window function from a group comprising at least Hann, Hamming, Bartlett and Blackmann-Harris window functions.

11. The method according to claim 1, wherein said first length of the first window function is in the range between 2 milliseconds and 32 milliseconds, and said second length of the second window function is in the range between 10 milliseconds and 96 milliseconds.

12. The method according to claim 11, wherein said first length of the first window function is equal to said second length of the second window function.

13. The method according to claim 1, wherein said step of providing the adaptive time-frequency bin comprises applying a weighting constant to a time-frequency bin.

14. The method according to claim 13, wherein said weighting constants can be varied as a function of time.

15. A hearing aid system comprising an adaptive filter bank configured to provide an adaptive time-frequency distribution of a digital input signal representing the output from an input transducer of the hearing aid system, wherein said adaptive filter bank is configured such that a time-frequency bin X (k,i) of said time-frequency distribution is determined as either:

$$X(k, i) = X_1(k, i) + X(k, i-1)e^{\frac{2\pi jRk}{L}}$$

or as $$X(k, i) = X_1(k, i)$$

wherein $X_1$ (k,i) is a time-frequency bin resulting from a discrete Fourier transform of a digital input signal based on a zero-padded second window comprising a single first window, and wherein k and i represent the frequency and time indices respectively, wherein X (k,i−1) represents a time-frequency bin based on the zero-padded second window comprising one or more of said first windows calculated at a previous time sample i−1 relative to the current time sample i, wherein L represents the length of the second window and R represents the hop-size of the first windows when summing these in the time domain, wherein X (k,i) is calculated as $$X_1(k, i) + X(k, i-1)e^{\frac{2\pi jRk}{L}}$$

in response to a determination of the digital input signal being stationary, and wherein X (k,i) is calculated as $X_1$ (k, i) in response to a determination of the digital input signal not being stationary.

16. The hearing aid system according to claim 15, wherein the adaptive filter bank is configured to determine the stationarity of the digital input signal based on an energy measure R(k,i) of the digital input signal being above or below a predetermined threshold, wherein said energy measure is selected from a group of energy measures R(k,i) comprising at least:

$$R(k, i) = \frac{|X_1(k, i)|^2}{|X(k, i-1)|^2 / M}$$

and $$R(k, i) = \frac{\Sigma_K |X_1(k, i)|^2}{\Sigma_K |X(k, i-1)|^2 / M}$$

wherein M is the number of first windows that has been summed in order to be comprised in the second window, and wherein K is a number of neighboring frequency bins.

17. The hearing aid system according to claim 16, wherein the adaptive filter bank is configured to detect a non-stationarity in case an energy measure is above a first predetermined threshold or in case the energy measure is below a second predetermined threshold.

18. The hearing aid system according to claim 17, wherein the adaptive filter bank is configured such that the first predetermined threshold is in the range between 1.4 and 2.0, and such that the second predetermined threshold is in the range between 0.7 and 0.5.

* * * * *